United States Patent [19]

Desanta

[11] Patent Number: 4,865,384

[45] Date of Patent: Sep. 12, 1989

[54] CHAIR WITH SEAT BIASING MEANS

[75] Inventor: Simon Desanta, Guetersloh, Fed. Rep. of Germany

[73] Assignee: Haworth, Inc., Holland, Mich.

[21] Appl. No.: 280,463

[22] Filed: Dec. 6, 1988

[30] Foreign Application Priority Data

Dec. 8, 1987 [DE] Fed. Rep. of Germany ..... 3741472

[51] Int. Cl.[4] ..... A47G 3/18

[52] U.S. Cl. ..... 297/304; 297/301; 297/320

[58] Field of Search ..... 297/300, 301, 304, 316, 297/320

[56] References Cited

U.S. PATENT DOCUMENTS

| | | | |
|---|---|---|---|
| 3,163,409 | 12/1964 | Running et al. | 297/304 X |
| 3,868,144 | 2/1975 | Lie | 297/304 |
| 3,913,975 | 10/1975 | Carter | 297/316 X |
| 4,067,610 | 1/1978 | Doerr et al. | 297/301 |
| 4,575,150 | 3/1986 | Smith | 297/300 |
| 4,682,814 | 7/1987 | Hansen | 297/301 X |
| 4,709,962 | 12/1987 | Steinmann | 297/301 |

*Primary Examiner*—Peter A. Aschenbrenner
*Attorney, Agent, or Firm*—Flynn, Thiel, Boutell & Tanis

[57] ABSTRACT

A chair, in particular an office chair, comprising a vertical base starting out from a bottom part, a seat plate which is connected pivotally about a first horizontal transverse axis to a forwardly directed support arm of the base, and a bar receiving a back rest, which bar is connected swingably to the base along a second horizontal transverse axis and is connected swingably to the rear area of the seat plate through a third horizontal transverse axis which, at the same time, permits relative movement between the bar and seat plate perpendicularly with respect to the third transverse axis. A torsion spring has at least one spring arm which extends at an angle from the torsion axis. The torsion spring is rotationally supported on the support arm with its torsion axis parallel with respect to the first horizontal transverse axis. The spring arm extends below the rear area of the seat plate and is there supported in a support bearing on the underside of the seat plate and a slide bearing on the bar.

9 Claims, 2 Drawing Sheets

CHAIR WITH SEAT BIASING MEANS

FIELD OF THE INVENTION

This invention relates to a spring mechanism for a chair seat.

BACKGROUND OF THE INVENTION

The invention relates to a chair, in particular an office chair, comprising a vertical base starting out from a bottom part, a seat plate which is pivotally connected about a first horizontal transverse axis to a forwardly directed support arm of the base, and a bar receiving the back rest, which bar is connected swingably about a second horizontal transverse axis to the base and is connected swingably through a third horizontal transverse axis to the rear area of the seat plate, which latter axis at the same time permits a relative movement between the bar and seat plate perpendicularly to the third transverse axis.

Chairs with a chair mechanism of the described type are known in various designs. The front end of the seat plate and the lower end of the bar are in all cases connected pivotally to the base or its support arm, and the rear end of the seat plate is connected to the bar of the back rest in a slide bearing, which at the same time permits a swinging movement. The swinging movement of the seat plate is in such chair mechanism forcedly coupled with the one of the back rest. However, the back rest covers a larger angle of swing than the seat plate. This corresponds with the ergonomic needs of the user during an adjustment of the chair between an erect working position and a leaning-back rest position. Regarding the state of the art, reference is made to German Nos. GM 77 11 865, AS 28 22 574, OS 29 04 148 and European Patent No. 014 001.

Furthermore, it is generally known for chairs of the mentioned type and others to have a spring act against the adjustment in the leaning-back rest position. Since the forces which are to be absorbed by the spring are significant, it is relatively difficult to find a spring which is, on the one hand, sufficiently large in order to be able to absorb the forces and is, on the other hand, substantially nonvisible and can be stored in the usual casing on the underside of the seat plate. Thus, for example, according to German No. GM 77 11 865, a gas pressure spring is provided behind the back rest, which requires an additional rear casing for the back rest. In other constructions, the occurring forces are distributed onto several smaller springs so that a considerable structural input is needed. U.S. Pat. No. 2,321,385, which must also be mentioned in the present case, provides a compression spring which lies freely in front of the base and which not only influences the appearance of the chair but also presents a danger regarding injury.

Therefore, the basic purpose of the invention is to produce a chair of the type of this class, in which the problem of the springy support of the seat plate and of the back rest is solved in a structurally simple and yet strong and sturdy manner.

This purpose is attained inventively by a torsion spring with at least one spring arm which is angled from the torsion axis, which torsion spring is supported with its torsion axis parallel to the first horizontal transverse axis fixed against rotation on the support arm or the base, which spring arm extends under the rear area of the seat plate and is there supported in a support bearing on the underside of the seat plate and a slide bearing on the bar.

The rearwardly directed arm of the torsion spring serves thus at the same time to support the rear side of the seat plate and serves the movable and swingable connection of the seat plate to the bar. With this a double function is met, which s far required on the one hand a swivel and slide bearing between the seat plate and bar, and on the other hand a separate fastening of the spring. From this results a significant structural simplification. Furthermore, combining two functions results in saving space, which makes it possible to store the spring with the bearings on the seat plate and the bar in a relatively flat casing on the underside of the seat plate.

Since not only a sliding movement but also an, even though slight, swinging movement occurs between the rear end of the seat plate and the bar, the invention offers the further advantage that in the inventively chosen arrangement by bending the rear end of the spring and/or by deforming a slide bearing, which consists for example of elastic plastic material, this swinging movement is made possible. The slide bearing can, moreover, also be constructed such that it permits a tilting movement of the spring.

BRIEF DESCRIPTION OF THE DRAWINGS

One preferred exemplary embodiment of the invention is discussed in greater detail hereinafter, in connection of the attached drawings, in which.

DETAILED DESCRIPTION

Figure 1:
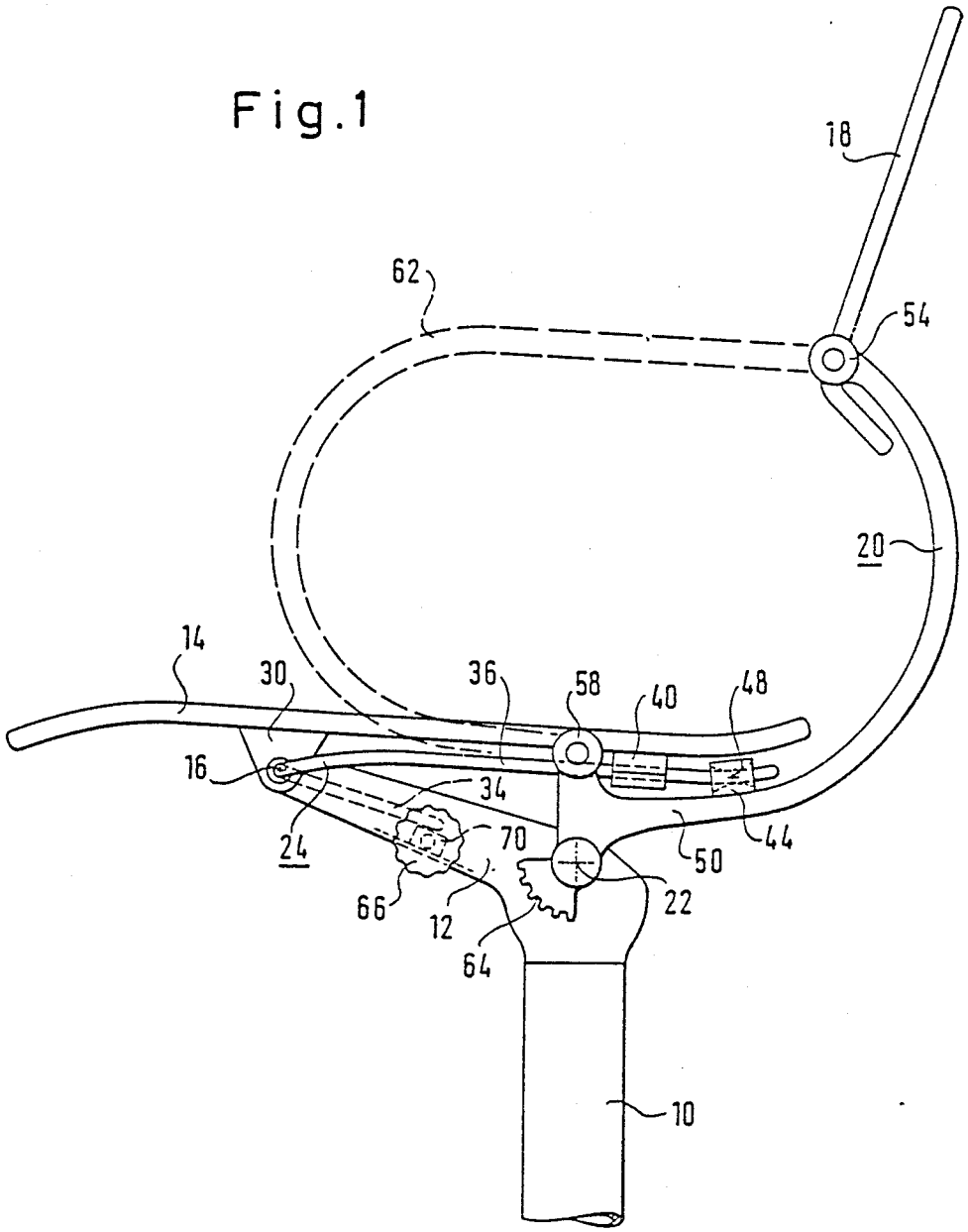
FIG. 1 is a schematic side view of an inventive chair.

FIG. 1 illustrates the upper area of a pedestal or base 10, at the upper end of which is fastened a support arm 12 which is directed forwardly in relationship to the position of the seat or to the left in FIG. 1. As can be recognized in FIG. 2, the support arm 12 spreads apart and is wedge-shaped as it projects forwardly. The front area of a seat plate 14 is supported about an axis 16 at the front end of the support arm 12, which axis 16 is directed transversely (i.e. sidewardly) with respect to the seat position and otherwise horizontally, and is therefore identified as the first horizontal transverse axis 16.

Furthermore a back rest 18 is part of the basic parts of the chair, which back rest 18 is carried by a bar 20 which extends downwardly below the rear end of the seat plate 14 and is supported pivotally about a second horizontal transverse axis 22 defined at the upper end of the base 10 in the base area of the support arm 12.

Both the bar 20 and the seat plate 14 are thus swingable in relationship to the base 10 or its support arm 12. For the purpose of a forced coupling of this swinging movement, the rear end of the seat plate 14 is additionally connected to the bar 20, as will be discussed later on.

Figure 2:
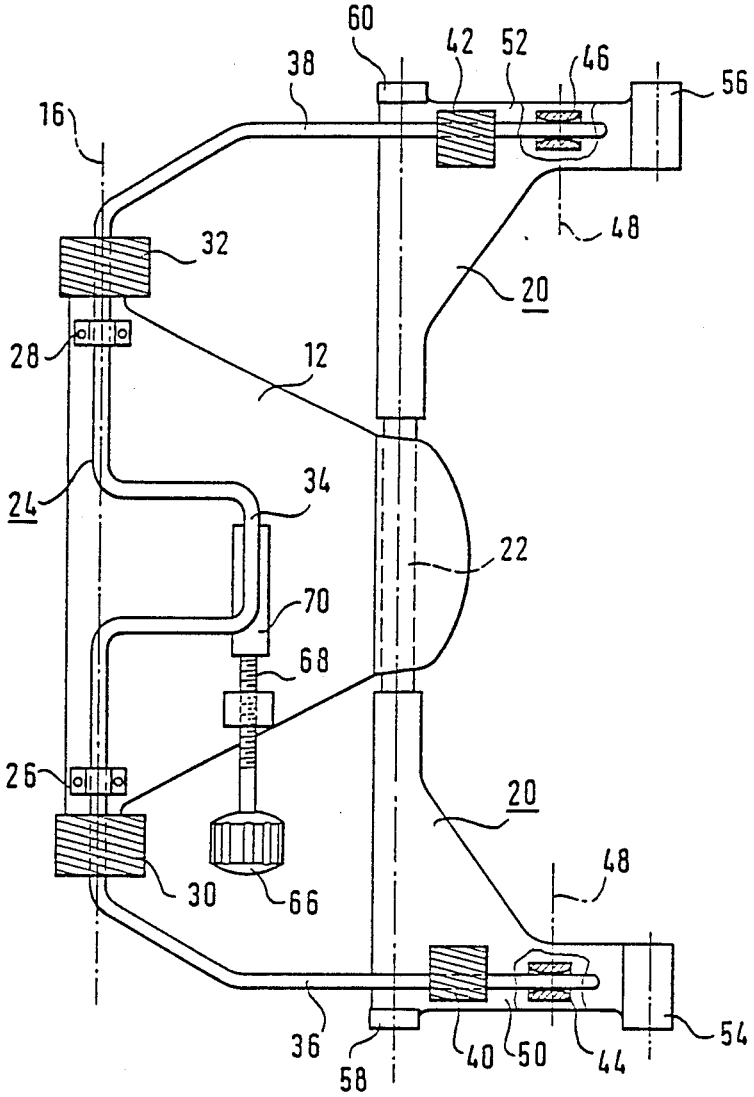
FIG. 2 is a top view of the base, the support arm and the bar of the back rest with the seat plate not shown.

A torsion spring 24, the torsion axis of which lies along the already-mentioned first horizontal transverse axis 16, is provided on the support arm 12 according to FIG. 2. The torsion spring 24 is fastened on the support arm 12 for example with the help of brackets 26, 28 which permit a rotation of the torsion spring during the torsion deformation. The torsion spring 24 projects to both sides beyond the support art 12 and runs through bearing blocks 30, 32 which, according to FIG. 1, are secured on the underside of the seat plate 14. The torsion spring 24 thus forms at the same time the swivel axis for the front end of the seat plate 14.

The torsion spring 24 has, in its center area, a U-shaped or recessed part 34, which is supported on the support arm 12 for rotationally fixedly supporting the torsion spring on the support arm with respect to the occurring forces.

The torsion spring 24 has, outside of the bearing blocks 30 and 32, at both ends, substantially perpendicularly rearwardly bent spring arm 36, 38 which extend under the rearward end of the seat plate 14. The spring arms 36, 38 are fixedly connected to the seat plate 14 with the help of support bearings 40, 42 which are fixed to the seat plate 14 in the rear area thereof. Since the torsion axis of the torsion spring 24 and the geometric axis about which the chair plate 14 is pivoted, namely the first horizontal transverse axis 16, are identical, no relative movement whatsoever takes place in the area of the support bearings 40, 42.

The spring arms 36, 38 extend rearwardly beyond the support bearings 40, 42 and enter into slide bearings 44, 46 which are fixed to the bar 20 adjacent the rear of the seat plate 14. The slide bearings 44, 46 have a X-shaped bore (as indicated by dotted lines in FIG. 1) which enlarges toward both ends so that the spring arms 36, 38 are not only slidable in the slide bearings 44, 46, but are also swingable. The rear end of the seat plate 14 is therefore connected to the bar 20 about a third horizontal transverse axis, as identified with reference number 48, which axis 48 extends transversely through the bearings 44, 46. Said transverse axis 48 permits a reciprocal movement and simultaneously a reciprocal swinging (i.e. pivoting).

The bar 20 has in the illustrated embodiment a special design because it does not, as is often the case, extend along the longitudinal center plane of the chair from the base to the back rest, but rather is constructed in two parts as can be seen in FIG. 2. The bar 20 is according to FIG. 2 supported about the already-mentioned second horizontal transverse axis 22 at the base area of the support arm 12. The bar 20 extends along the transverse axis 22 outwardly beyond both sides of the arm 12, and then extends upwardly in FIG. 2 and rearwardly below the seat plate and, as can be seen in FIG. 1, at the same time upwardly. The rearwardly-extending lateral legs 50, 52 formed in this manner have at their upper ends sleeves 54, 56 with horizontal, transversely directed bores which swingably support the back rest 18. Similar sleeves 58, 60 are provided at the upper end of the upwardly-extending legs 50, 52 above the transverse axis 22. The sleeves 54, 56 and 58, 60 are used to receive arm rests 62 which are indicated by dotted lines. The slide bearings 44, 46 are secured on the lateral legs 50, 52 of the bar 20.

A toothed segment 64 is connected to the bar 20 and extends downwardly beyond the transverse axis 22 and permits, in a manner which is not illustrated in detail, the locking of the seat plate 14 to the bar 20 in various positions. A regulator wheel or knob 66 projects laterally from the support arm 12. A threaded spindle 68 can be rotated with the help of the regulator knob 66, with the longitudinal movement of the threaded spindle being transferred onto a wedge-shaped support member 70, which supports U-shaped part 34 of the torsion spring 24. By moving the wedge-shaped support member 70, the position and hence the torsion of the torsion spring 24 can be changed in relationship to its initial tension.

As was discussed earlier in connection with one exemplary embodiment, only relatively few parts are needed for the manufacture of the inventive chair, so that a simplification and thus price reduction of the construction results without having to accept significant disadvantages. The simplification is substantially based on the torsion spring 24 not only producing the necessary spring force, but it is used at the same time as the front swivel axis of the seat plate 14 and forms with the rear ends of its spring arms 36, 38 the hinged and movable connection between the seat plate and the bar of the back rest.

The embodiments of the invention in which an exclusive property or privilege is claimed are defined as follows:

1. A chair, in particular an office chair, including a vertical base starting out from a bottom part, a seat plate which is pivotally connected about a first horizontal transverse axis to a forwardly directed support arm of the base, and a bar receiving a back rest, which said bar is swingably connected to the base about a second horizontal transverse axis and is swingably connected to a rear area of the seat plate through a third horizontal transverse axis which permits, at the same time, relative movement between the bar and seat plate perpendicularly with respect to the third transverse axis, the improvement comprising a torsion spring with at least one spring arm which is angled outwardly from a torsion axis, which said torsion spring is supported on the support arm or the base with its torsion axis parallel with respect to the first horizontal transverse axis and fixed against rotation, which said spring arm extends below the rear area of the seat plate and is there supported in both a support bearing on the underside of the seat plate and a slide bearing on the bar.

2. A chair according to claim 1, wherein the torsion axis of the torsion spring corresponds with the first horizontal transverse axis of the seat plate.

3. A chair according to claim 2, wherein the torsion spring is as a whole of a U-shaped construction and has angled spring arms at both ends which extend under the rear area of the seat plate.

4. A chair according to claim 3, characterized in that the torsion spring has a recessed part which projects radially from the torsion axis and which is supported on the support arm in a center area of the seat plate.

5. A chair according to claim 4, including a regulating member for adjustable support of the recessed part.

6. A chair according to claim 3, wherein the spring arms are held on the underside of the seat plate in front of the support on the bar.

7. A chair according to claim 3, wherein the rear ends of the spring arms are guided on the bar in bores of slide bearings, the bores of said slide bearings have a X-shaped longitudinal cross section.

8. A chair according to claim 2, wherein the torsion spring forms in the area of its torsion axis the swivel axis for a front area of the seat plate.

9. A chair according to claim 8, wherein bearing blocks are secured on the underside of the seat plate in its front area, which said bearing blocks receive the torsion spring in bores thereof.

* * * * *